US010149083B1

(12) United States Patent
Pittman et al.

(10) Patent No.: US 10,149,083 B1
(45) Date of Patent: Dec. 4, 2018

(54) CENTER POINT STEREO SYSTEM

(71) Applicant: Aspen & Associates, San Fernando, CA (US)

(72) Inventors: Richard Aspen Pittman, Sylmar, CA (US); Marshall David Buck, Los Angeles, CA (US)

(73) Assignee: ASPEN & ASSOCIATES, San Fernando, CA (US)

( * ) Notice: Subject to any disclaimer, the term of this patent is extended or adjusted under 35 U.S.C. 154(b) by 0 days.

(21) Appl. No.: 15/652,225

(22) Filed: Jul. 17, 2017

Related U.S. Application Data

(60) Provisional application No. 62/363,732, filed on Jul. 18, 2016.

(51) Int. Cl.

| | |
|---|---|
| ***H04S 3/00*** | (2006.01) |
| ***H04R 5/02*** | (2006.01) |
| ***H04R 5/04*** | (2006.01) |

(52) U.S. Cl.
CPC ..... *H04S 3/008* (2013.01); *H04R 5/02* (2013.01); *H04R 5/04* (2013.01); (Continued)

(58) Field of Classification Search
CPC ..... H04R 2201/028; H04R 5/00; H04R 5/02; H04R 5/04; H04R 5/033; H04S 2400/01; H04S 2400/05; H04S 3/008
(Continued)

(56) References Cited

U.S. PATENT DOCUMENTS 6,219,426 B1 * 4/2001 Daniels ..... H04R 5/02 381/17
7,460,673 B2 12/2008 Miller
(Continued)

OTHER PUBLICATIONS

MT, MT-130, 2014, p. 2.*
Analog Devices, ADAU1701 Mini Evaluation Board, Analog Devices, Inc. Norwood MA, U.S.A. 12 pages, copyright 2009.

*Primary Examiner* — William A Jerez Lora
(74) *Attorney, Agent, or Firm* — John J. Connors; Connors & Assoc. pc

(57) ABSTRACT

In an audio processing system a center point stereo sound processor in combination with a digital transducer alignment sound processor converts regular left and right stereo audio source signals to sum and difference signals, enabling a center stage spatialized stereo acoustic image to be created directly from a forward-directed loudspeaker unit and a sideways-directed dipole loud speaker unit. The forward-directed loudspeaker unit includes one vertically-mounted loudspeaker. The sideways-directed dipole loudspeaker unit is located directly below and to the sides of the forward-directed loudspeaker unit and includes two speaker cones connected in parallel and wired out of phase with each other. The center point stereo sound processor receives a left and right, stereo, audio signal source and converts the left and right signals into sum and difference signals. The sum, left plus right signal drives the forward-directed loudspeaker unit. The difference, left minus right signal is subsequently processed by the digital transducer alignment sound processor, which then drives the sideways-directed dipole loudspeaker unit. The digital transducer alignment sound processor applies an audio time delay to the difference signal equal to or longer than that of the delay in sound transmission delay in air from the vertically-mounted loudspeaker of the forward-directed loudspeaker unit to the two speaker
(Continued)

cones of the sideways-directed dipole loudspeaker unit. This acoustically repositions the sideways-directed dipole loudspeaker unit so it radiates in the time domain as if the sideways-directed dipole loudspeaker unit was centrally located in reference to the forward-directed loudspeaker unit.

1 Claim, 12 Drawing Sheets

(52) U.S. Cl.
CPC .... *H04R 2201/028* (2013.01); *H04S 2400/01* (2013.01); *H04S 2400/05* (2013.01)

(58) Field of Classification Search
USPC ..... 381/1, 17, 300, 303
See application file for complete search history.

(56) References Cited

U.S. PATENT DOCUMENTS

| | | | | |
|---|---|---|---|---|
| 2005/0265558 | A1 | 12/2005 | Neoran | |
| 2007/0127738 | A1* | 6/2007 | Yamada | H04R 3/04 381/98 |
| 2010/0331048 | A1 | 12/2010 | Xiang et al. | |
| 2015/0138916 | A1* | 5/2015 | Larkin | H04B 11/00 367/13 |

* cited by examiner

RL1
2
I
II
C1
160a
CP1
Apex End of
Forward Speaker
Cone
160
C2
180
180a
180b
d1
d2
RL2
RL2
F1
F2
Pm
Intersection of RL1 & RL2
RL1

TO LR MATRIX
TO LED CONTROL
Control BOARD
INPUTS BOARD
CH1 Input

TO LR MATRIX
TO LED CONTROL
Control BOARD
INPUTS BOARD
CH2 Input

CENTER POINT STEREO SYSTEM

RELATED PATENT APPLICATIONS & INCORPORATION BY REFERENCE

This Utility application claims priority under 35 U.S.C. 119 based on U.S. Provisional Patent Application No. 62/363,732, entitled "Center Point Stereo System," filed Jul. 18, 2016. This related patent application is incorporated herein by reference and made a part of this application. If any conflict arises between the disclosure of the invention in this application and that in the related patent application, the disclosure in this application shall govern. Moreover, any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. The word "rectangular" includes square.

BACKGROUND

A conventional stereo system will process and acoustically transduce an audio source signal into left and right stereophonic sound images emanating from two spatially separated loudspeaker units; each separately driven by dedicated amplifiers for the left and right signal channels. A center point stereo system is an improvement upon the conventional stereo system. The center point stereo system will process and acoustically transduce an audio source signal into stereophonic sound images emanating from two loud speaker units co-located at the center point of the stereo system. The center point stereo system utilizes a forward-directed loudspeaker unit and a sideways-directed dipole loudspeaker unit, driven respectively by the sum and difference signals derived from matrixing the standard left (L) and right (R) stereo signals. Examples of prior art center point stereo field expander systems are disclosed in U.S. Pat. Nos. 6,219,426 and 7,460,673; U.S. Publication No. 2010/0331048; U.S. Publication No. US2005/0265558A1; and, the Holger Lauridsen M-S speaker system method for creating a pseudo-stereo effect from a mono signal.

SUMMARY

A conventional center point stereo system has a pair of sideways-directed speaker cones displaced from a longitudinal reference line of the system's cabinet. Due to any lateral displacement of the sideways-directed speaker cones from the longitudinal reference line the sound source's origin from the center point of the forward-directed loudspeaker, and the wave fronts of the sideways-directed speaker cones, are no longer time aligned. This greatly diminishes the center point stereophonic image. Our improved center point stereo system comprises a digital transducer alignment sound processor unit including an audio time delay circuit that compensates for the lateral displacement of the sideways-directed speakers from the longitudinal reference line and the resulting time it takes the sound source to travel from the center point of the forward-directed loudspeaker to the front face of the sideways-directed speaker cones.

DESCRIPTION OF THE DRAWING

One embodiment of our improved center point stereo system is discussed in detail in connection with the accompanying drawing, which is for illustrative purposes only. This drawing includes the following figures (Figs.), with like numerals and letters indicating like parts.

PRIOR ART

FIGS. 1-3

Figure 1:
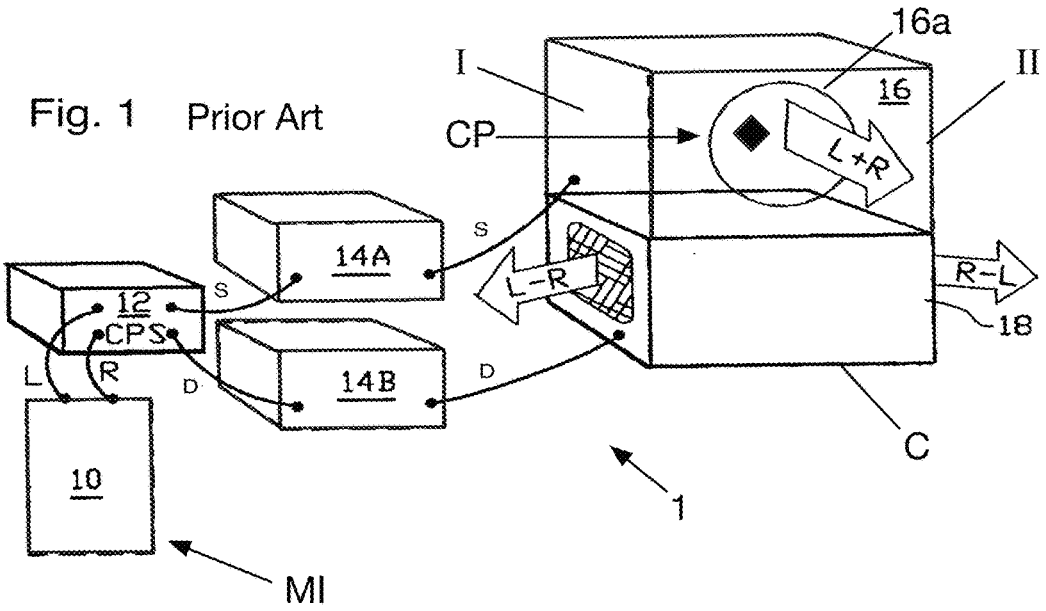
Fig. 1 Prior Art
FIG. 1 is a diagram of the prior art center point stereo system disclosed in U.S. Pat. No. 6,219,426.

Our center point stereo system is an improvement upon the system disclosed in U.S. Pat. No. 6,219,426 (Appendix A) and illustrated in FIGS. 1 through 3 (herein the Prior Art System). Disclosed in FIG. 1, a stereophonic (L and R) audio signal source 10 connects to the center point stereo processor 12 of a center point stereo system 1. The audio signal source 10 is generated by a stereophonic musical instrument MI; for example, an electronic keyboard or a guitar. The center point stereo processor 12 produces a sum of the left and right (L+R) portion of the audio source signal 10 and a difference of the left and right (L−R) of the audio source signal 10. The sum signal S is amplified by amplifier 14*a*, which drives the forward-directed loudspeaker unit 16. The difference signal D is amplified by amplifier 14*b*, which drives a sideways-directed dipole loudspeaker unit 18. The forward-directed loudspeaker unit 16 contains one vertically-mounted loudspeaker 16*a* and is arranged and oriented to emit sound in a generally forward direction originating from the center point CP. The sideways-directed dipole loudspeaker unit 18 contains two vertically-mounted loudspeakers 18*a* and 18*b* which are arranged and oriented to emit sound in a generally sideways direction. The dipole loudspeaker unit 18 is co-located in a cabinet enclosure C with the forward-directed loudspeaker unit 16. The cabinet enclosure C is a generally closed housing having two opposite parallel panels I and II, each configured with a speaker cutout opening. The loudspeaker unit 18 is constructed and arranged to emit sound in a dipole pattern, i.e., of opposite phase polarity causing them to directionally vibrate in unison, generally perpendicular to the forward direction of loudspeaker unit 16.

Figure 2:
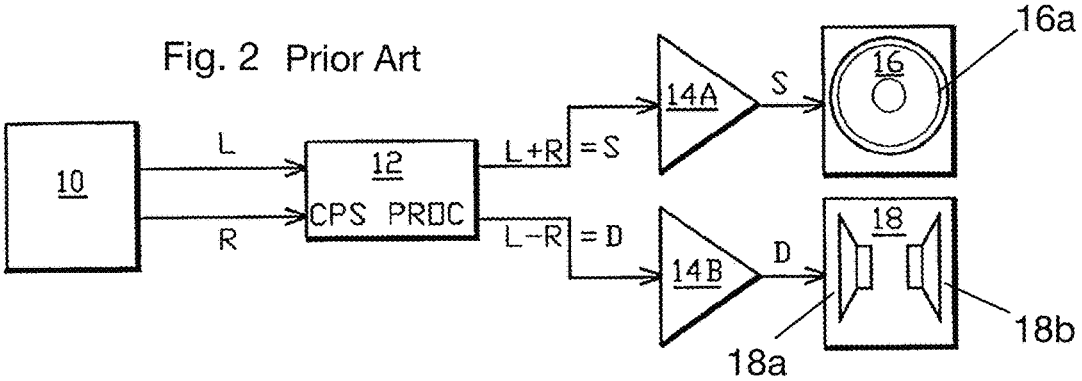
Fig. 2 Prior Art
FIG. 2 is a functional block diagram of the prior art center point stereo system depicted in FIG. 1.

As illustrated in FIG. 2, an audio signal source 10 provides a stereo audio output signal L and R. The L and R signals are delivered to the input of the center point stereo processor 12. Consequently, the respective L and R stereo signals are matrixed to provide a first line output and a second line output. The first line level output is the sum signal S consisting of left plus right component portions of the source signals (L+R), i.e., the sum of the two input left and right input signals. The second line level output is the difference signal D, consisting of left minus right component portions of the source signals (L−R), i.e., the difference between the two left and right input signals. The sum signal S is amplified by power amplifier 14A driving the forward-directed loudspeaker unit 16, from which an acoustic field of the L+R signal emanates from the center point CP in a generally forward direction. Similarly, the difference signal D is amplified by power amplifier 14B driving the dipole loudspeaker unit 18, from which an acoustic field emanates in a generally sideways direction in opposite phase relation, indicated as R−L on one side and L−R on the other side.

Figure 3:
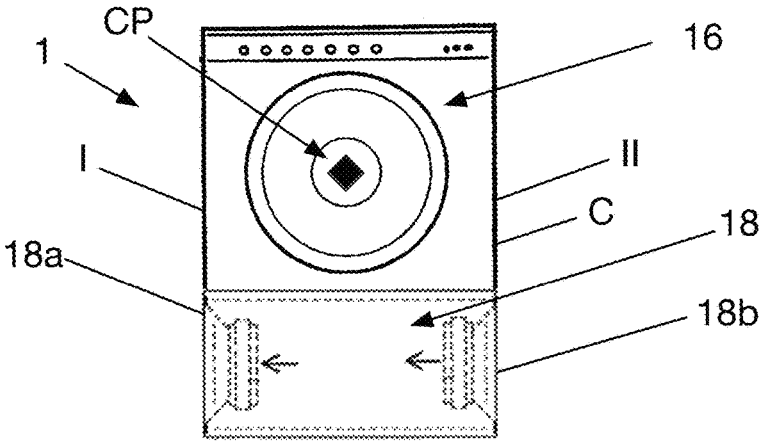
Fig. 3 Prior Art
FIG. 3 is a diagram of the prior art internal configuration of a dipole loudspeaker unit disclosed in U.S. Pat. No. 6,219,426.

As illustrated in FIG. 3, the dipole loudspeaker unit 18 is constructed in the manner of a conventional loud speaker enclosure, having no central baffle or large openings or ports other than those directly associated with the two speakers 18*a* and 18*b* shown in dashed outline mounted back-to-back at opposite sides of the dipole loudspeaker unit 18. The speakers 18*a* and 18*b* each have a cone diaphragm, and each are mounted on a respective side of the panels I and II in an acoustical operational relationship with the cutout opening thereof, said speakers being interconnected electrically in a manner to cause both cone diaphragms to vibrate in unison under a driven condition as indicated by the two arrows.

The problem with the Prior Art System is that any lateral displacement of the loudspeakers 18*a* and 18*b* from the center point CP of the forward-directed loudspeaker 16 causes a time difference between the audio signal source 10 originating from the center point CP and arriving at the face of loudspeakers 18*a* and 18*b*. The loudspeakers 18*a* and 18*b* are no longer time aligned to the audio signal sound source originating at the center point CP of the forward-directed loudspeaker 16. This greatly diminishes the center point stereophonic sound imaging effect and is counterproductive to the main advantage of the Prior Art "Center Point Stereo" System.

DETAILED DESCRIPTION OF ONE ILLUSTRATIVE EMBODIMENT

Figure 4:
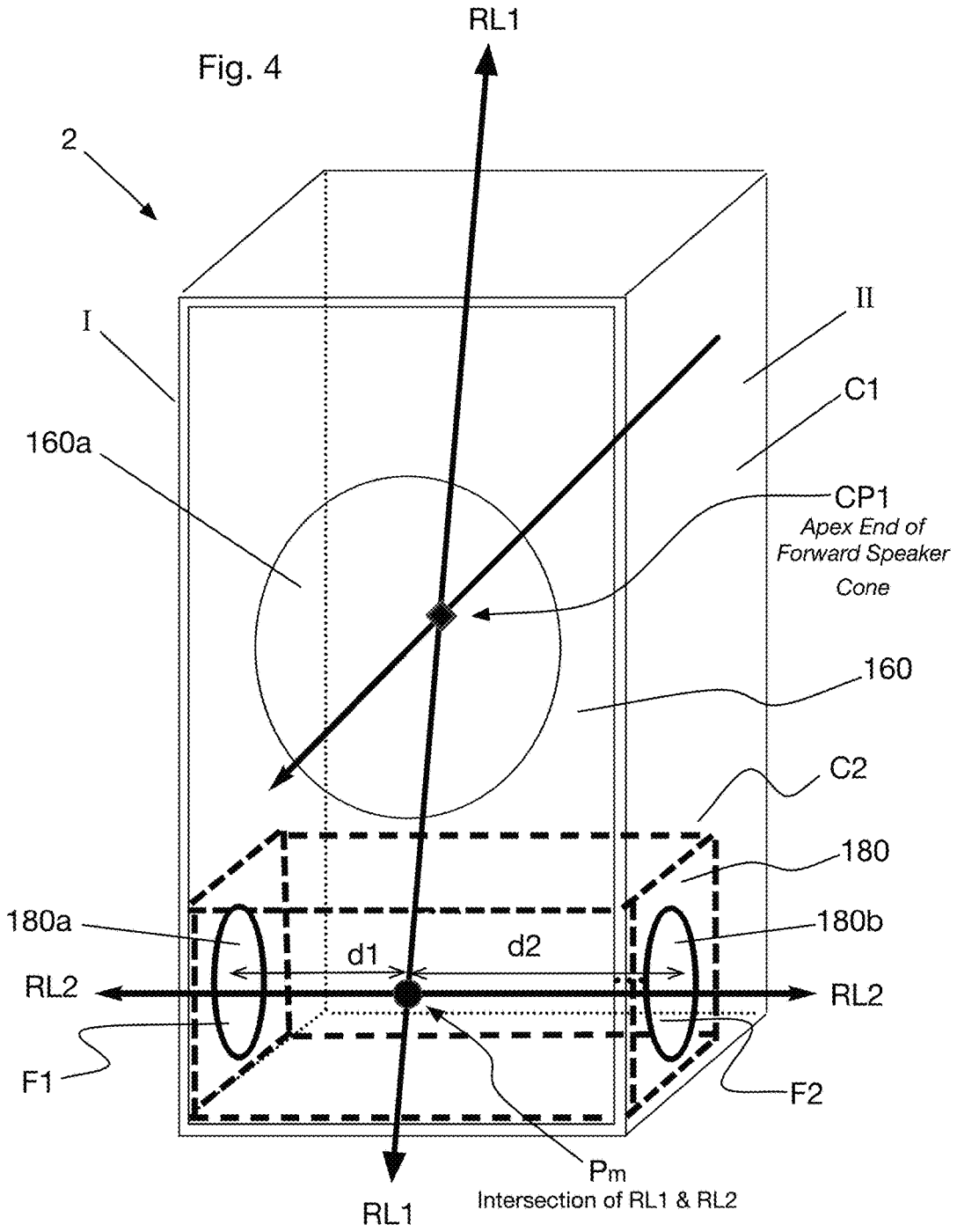
FIG. 4 is a perspective schematic illustration of our improved center point stereo system.
Figure 5:
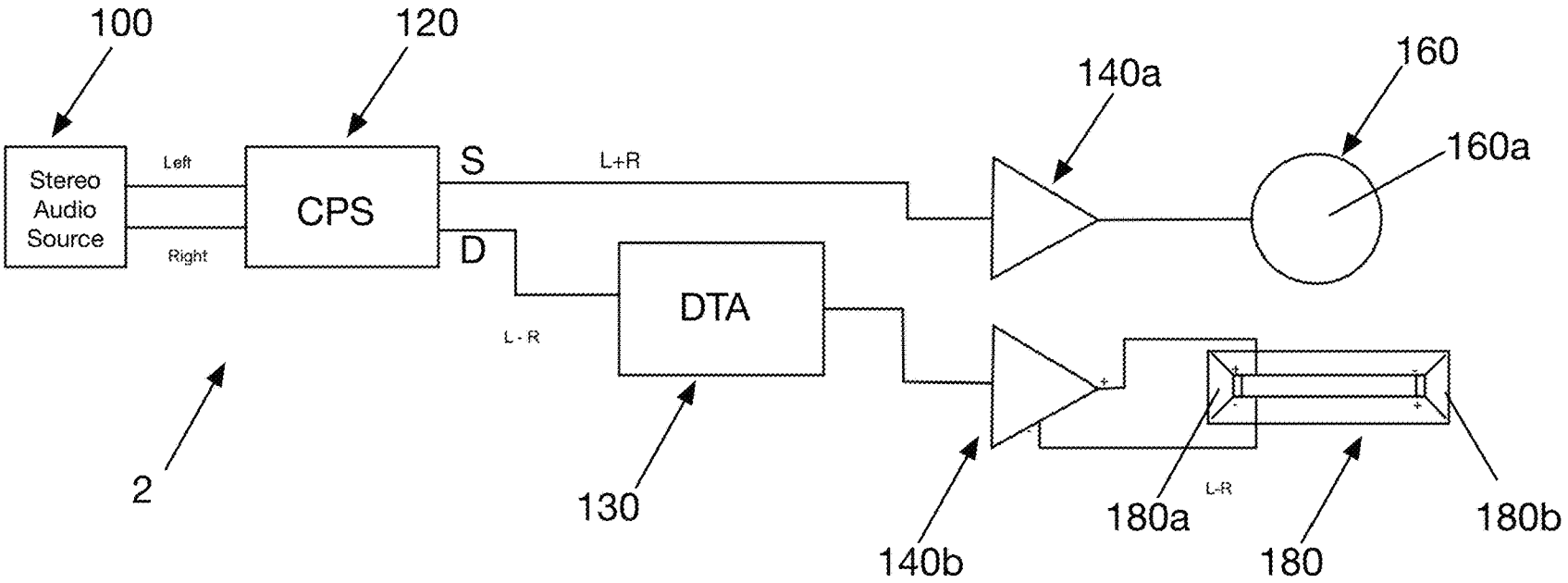
FIG. 5 is a functional block diagram of our improved center point stereo system depicted in FIG. 4.

FIGS. 4 and 5

Our improved center point stereo system 2 compensates for the loss of, and greatly improves the center point through the center point stereophonic sound imaging effect, when the sideways-directed dipole loudspeakers 180*a* and 180*b* are laterally displaced from the center point CP1 of the forward-directed loudspeaker unit 160. Our improved center point stereo system utilizes from the Prior Art System a center point stereo sound processor 120 (CPS) in combination with a digital transducer alignment sound processor 130 (DTA), not found in the Prior Art System. As illustrated in FIG. 4, and generally designated by the numeral 2, our improved center point stereo system comprises, in a single box-type package with rectangular sides, a forward-facing loudspeaker unit 160 in combination with a sideways-directed dipole loudspeaker unit 180.

The forward-directed loudspeaker unit 160 contains one vertically-mounted loudspeaker 160*a* with an apex end arranged to emit sound in a generally forward direction from a center point CP1 positioned along a longitudinal reference line RL1. The sideways-directed dipole loudspeaker unit 180 contains the loudspeakers 180*a* and 180*b*, disposed below and to the sides of the forward-directed loudspeaker unit 160, having their apex ends lying along a common lateral reference line RL2. The longitudinal reference line RL1 and the common lateral reference line RL2 intersect at a point $P_m$ midway between the faces, F1 and F2, of the respective pair of loudspeakers 180*a* and 180*b*. Within the sideways-directed dipole loudspeaker unit 180, the loudspeakers 180*a* and 180*b* are equally spaced apart latterly from point $P_m$ a distance that may range from 1 to 120 inches. For example in FIG. 4, the distance $d_1$ from the point $P_m$ to the face F1 of the loudspeaker 180*a* equals 8 inches, and the distance $d_2$ from the point $P_m$ to the face F2 of the loudspeaker 180*b* equals 8 inches. The loudspeakers 180*a* and 180*b* are configured to radiate 90 degrees transversely relative to the forward facing loudspeaker unit 160 and configured to vibrate in unison having opposite polarity through a parallel connection wired 180 degrees out of phase with respect to each other. When loudspeaker 180*a* moves left, loudspeaker 180*b* also moves left.

Figure 4A:
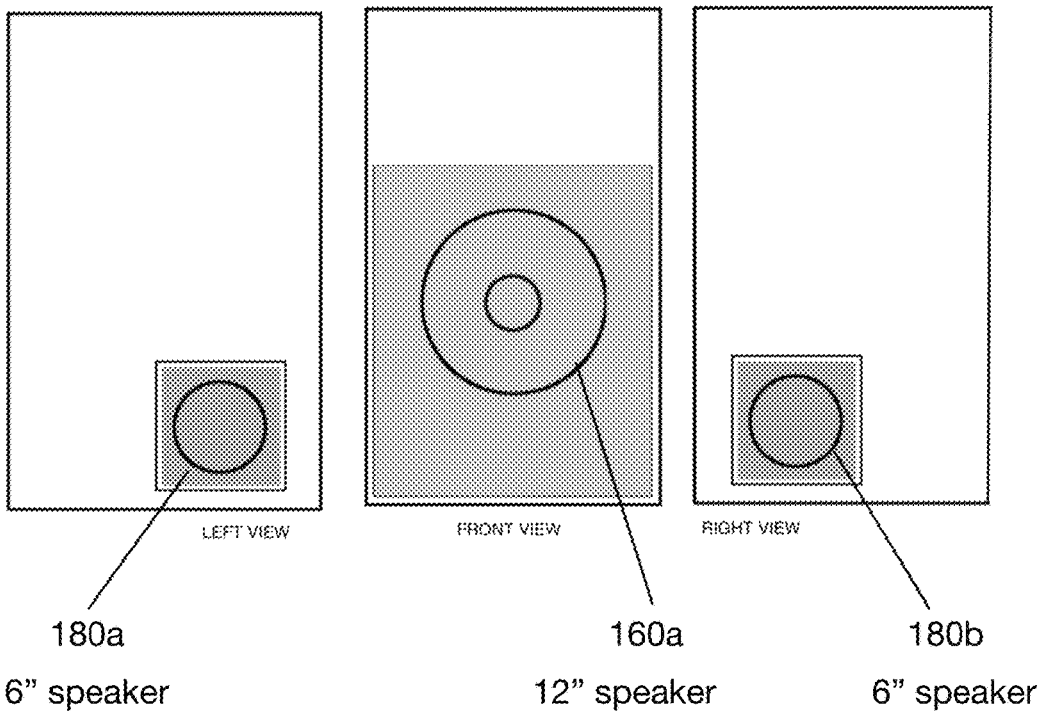
FIG. 4A is front and side schematic illustration of our improved center point stereo system depicted in FIG. 4.

As illustrated in FIG. 4, in dashed lines, the sideways-directed dipole loudspeaker unit 180 is contained in cabinet enclosure C2; co-located with the forward-directed loudspeaker unit 160 within the cabinet enclosure C1. The cabinet enclosure C1 is a generally closed housing having a speaker cutout opening for loudspeaker 160*a*, and two opposite parallel panels I and II, each configured with a speaker cutout opening for loudspeakers 180*a* and 180*b*. As illustrated in the embodiment of FIG. 4A, the forward-facing loudspeaker 160*a* is a 12-inch coaxial speaker, the rear of which is in communication with an enclosed air volume of approximately three cubic feet. The sideways-directed dipole loudspeakers 180*a* and 180*b* are a pair of 6-inch speakers respectively mounted on side I and II of the speaker cabinet C1. The sideways-directed dipole loudspeaker unit 180 is enclosed within its own sealed speaker cabinet C2 separate from the speaker cabinet C1 used by the forward-facing loudspeaker unit 160. In the embodiment of FIG. 4A, the cabinets C1 & C2 are 16 inches wide.

As illustrated in FIG. 5, a stereophonic audio source signal 100, such as an electronic keyboard, produces a stereophonic left and right output. The output of the audio source signal 100 is then processed by the center point stereo sound processor (CPS) 120 to create: (1) the sum, left plus right (L+R) center drive signal S; and, (2) the difference, left minus right (L−R) side drive signal D. The sum (L+R) signal S drives the amplifier 140*a*; acoustically transducing the vertically-mounted loudspeaker 160*a* of the forward-directed loudspeaker unit 160. The difference (L−R) signal D, is subsequently processed by the digital transducer alignment sound processor (DTA) 130, which then drives the amplifier 140*b*; acoustically transducing loudspeakers 180*a* and 180*b* of the sideways-directed dipole loudspeaker unit 180.

Figure 6A:
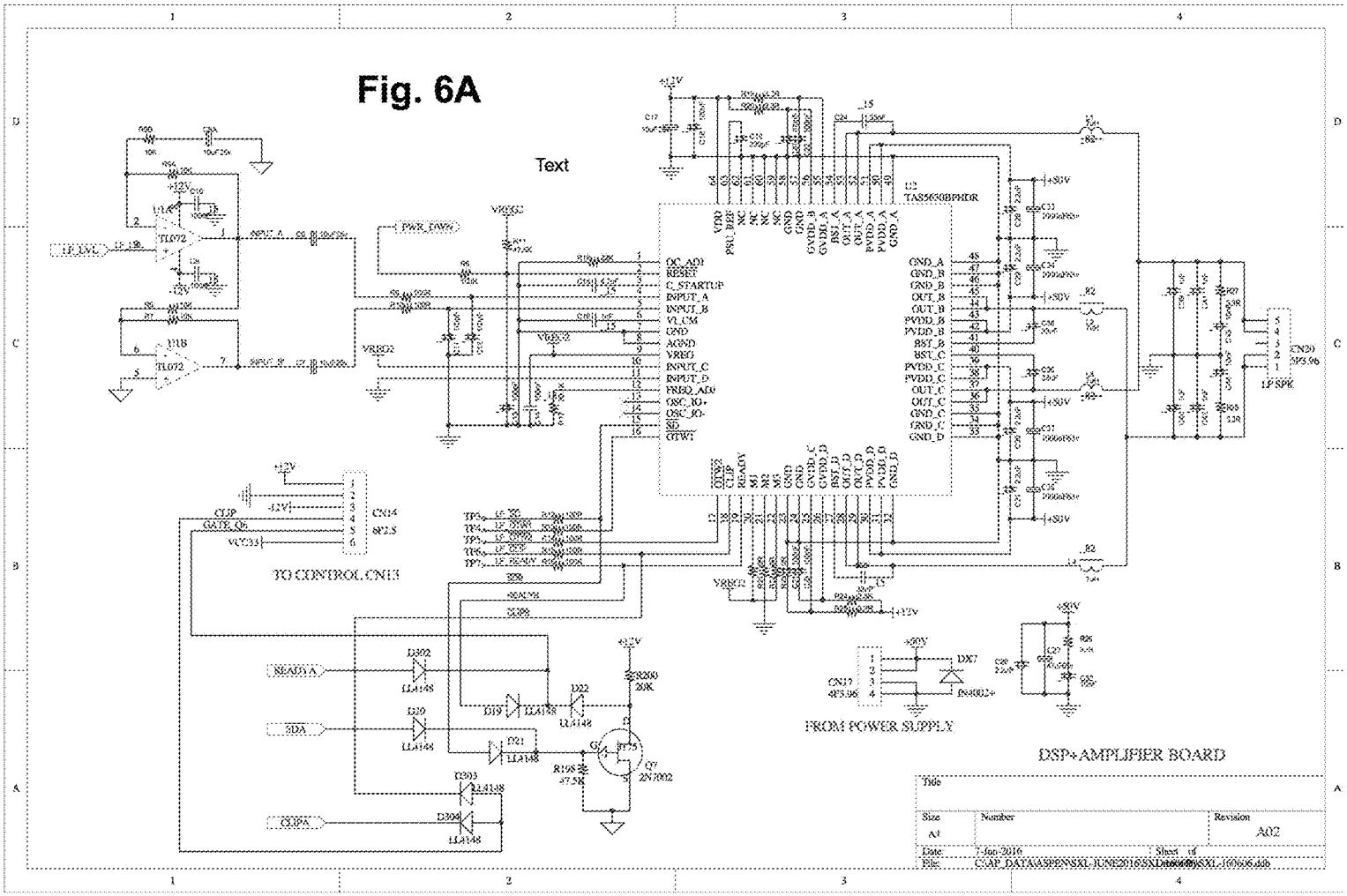
FIG. 6A is a detailed circuit diagram of the digital transducer alignment sound processor used in our improved center point stereo system.
Figure 6B:
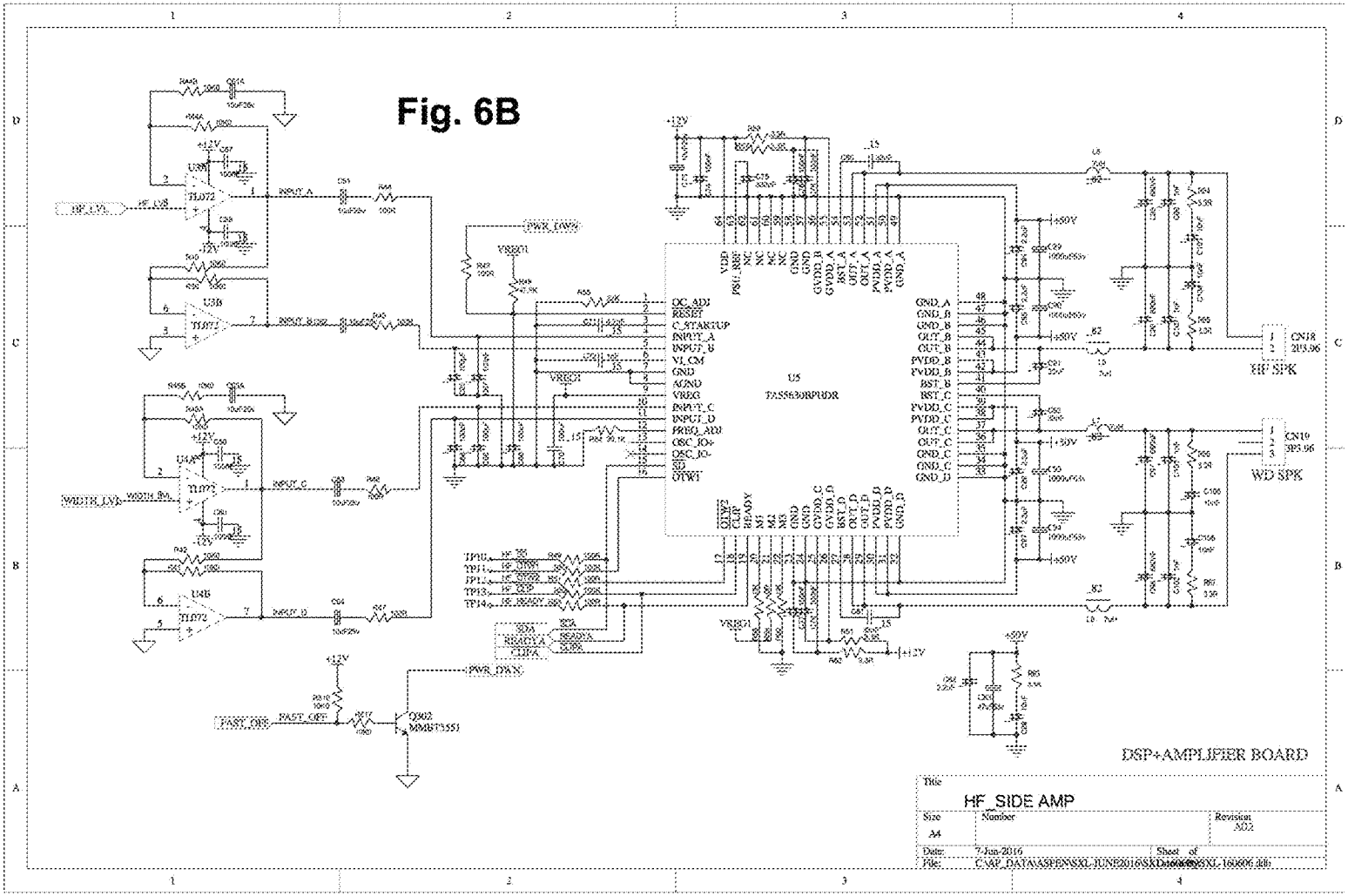
FIG. 6B is a detailed circuit diagram of the digital transducer alignment sound processor used in our improved center point stereo system depicted in FIG. 4.
Figure 6C:
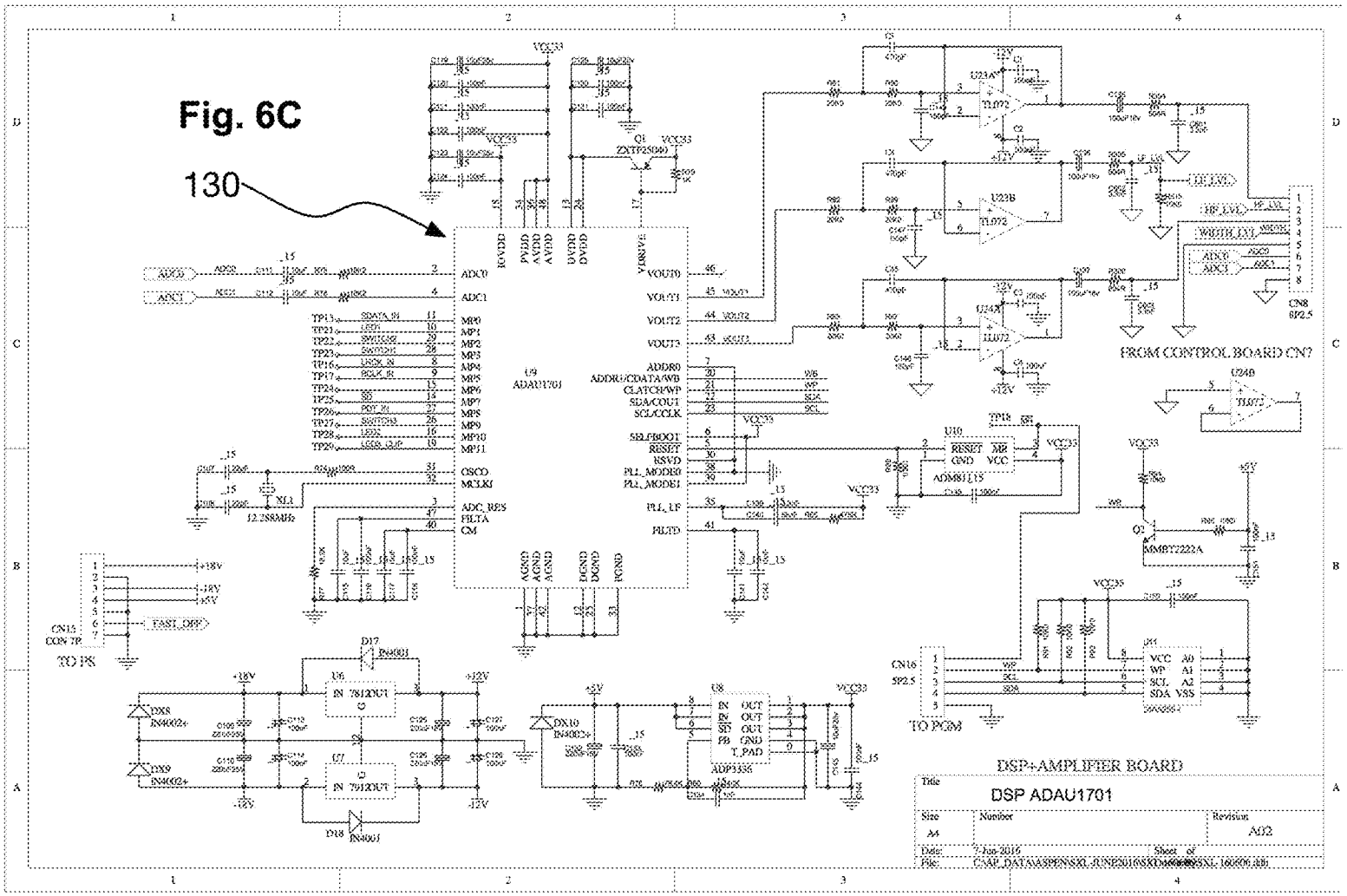
FIG. 6C is a detailed circuit diagram of the digital transducer alignment sound processor used in our improved center point stereo system depicted in FIG. 4.
Figure 6D:
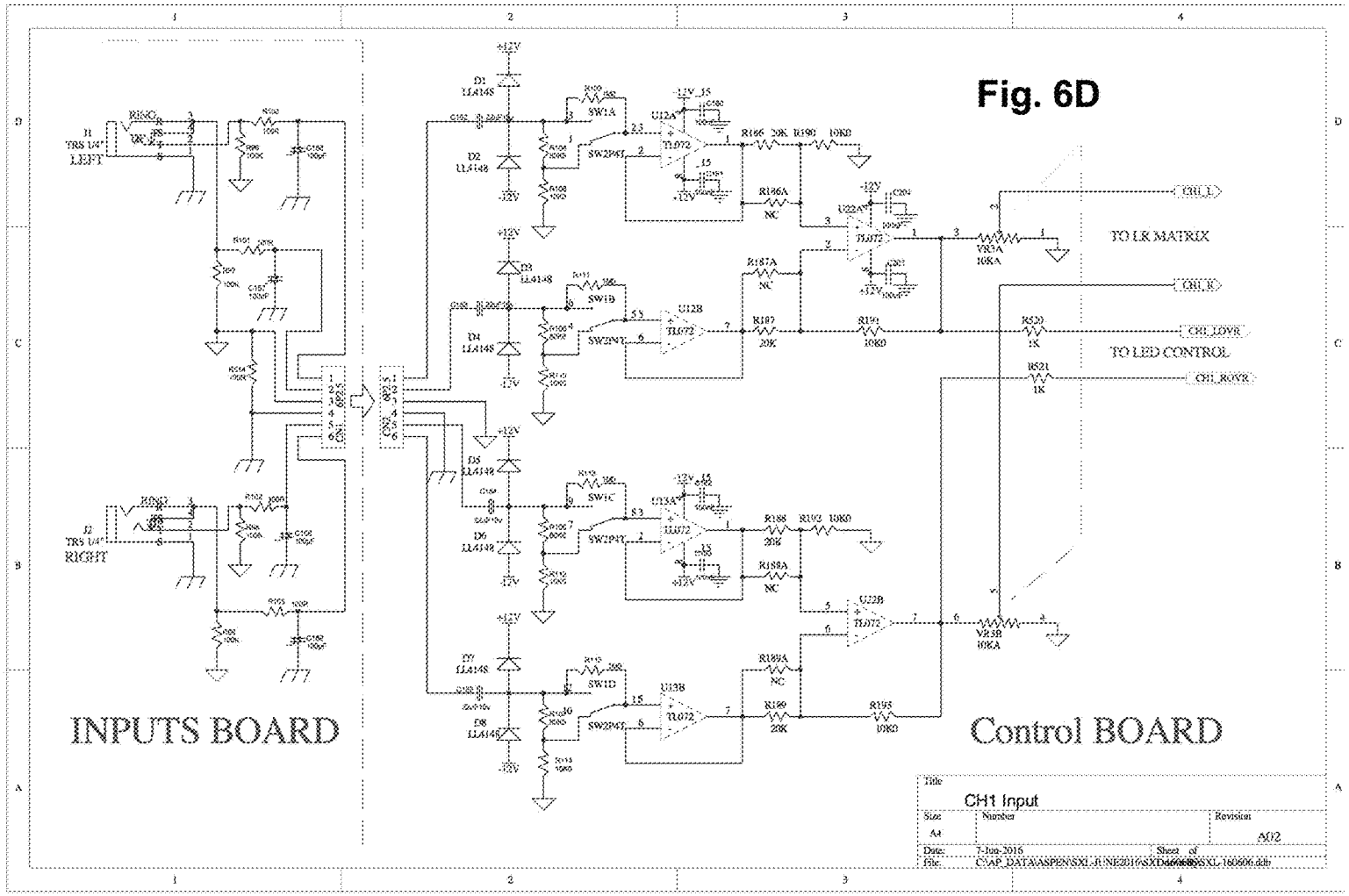
FIG. 6D is a detailed circuit diagram of the digital transducer alignment sound processor used in our improved center point stereo system depicted in FIG. 4.
Figure 6E:
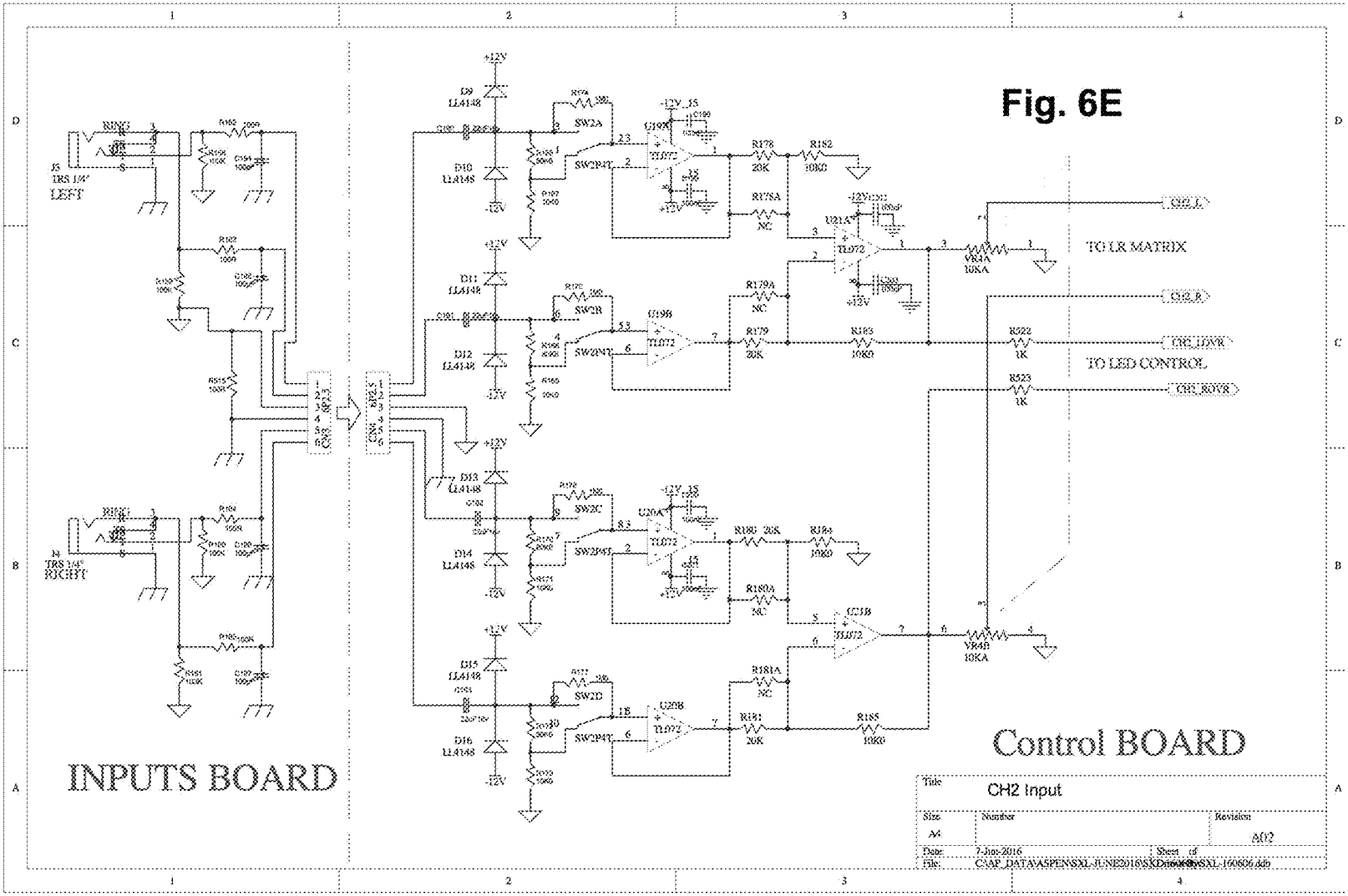
FIG. 6E is a detailed circuit diagram of the digital transducer alignment sound processor used in our improved center point stereo system.
Figure 6F:
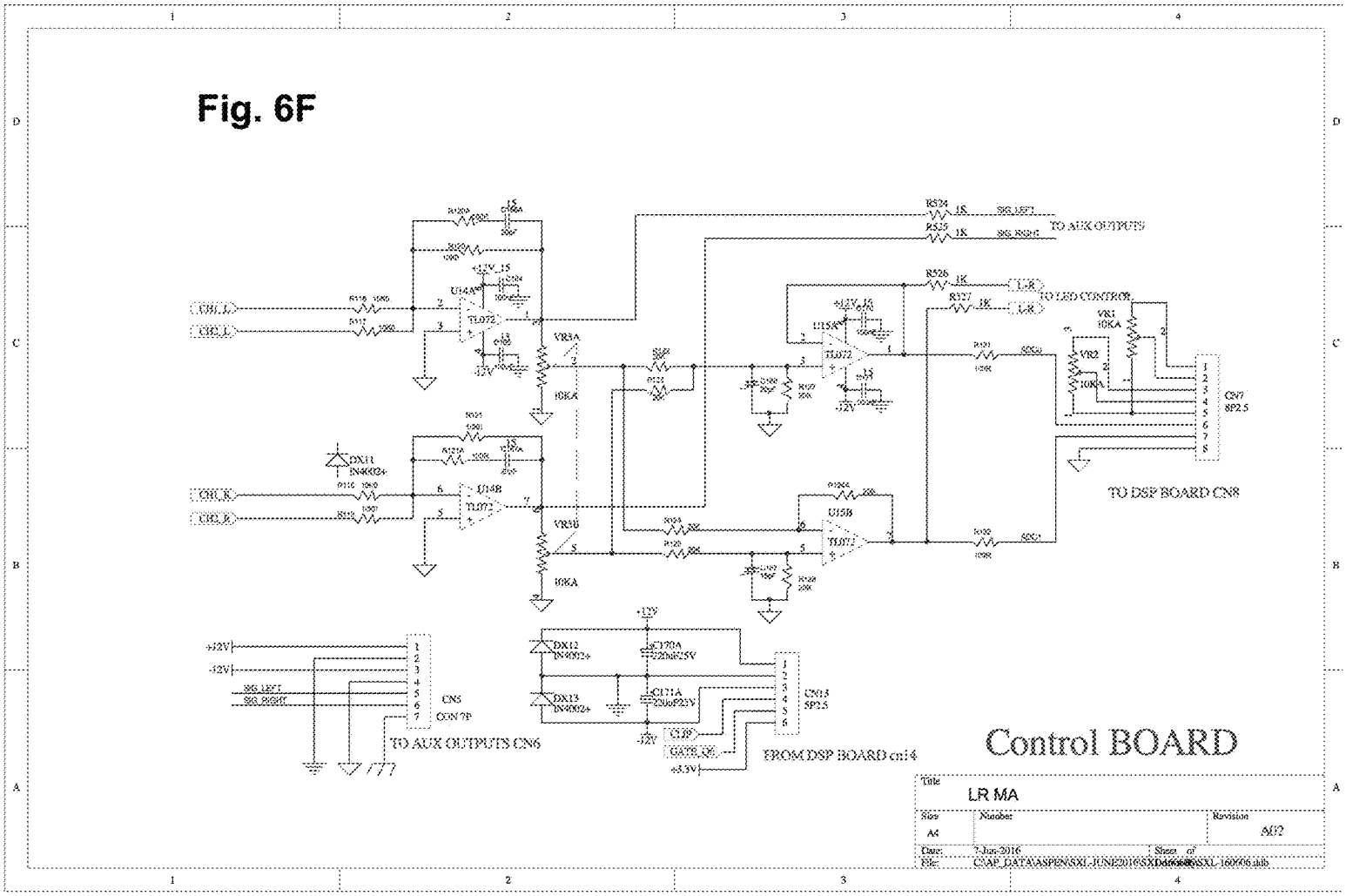
FIG. 6F is a detailed circuit diagram of the digital transducer alignment sound processor used in our improved center point stereo system depicted in FIG. 4.
Figure 6G:
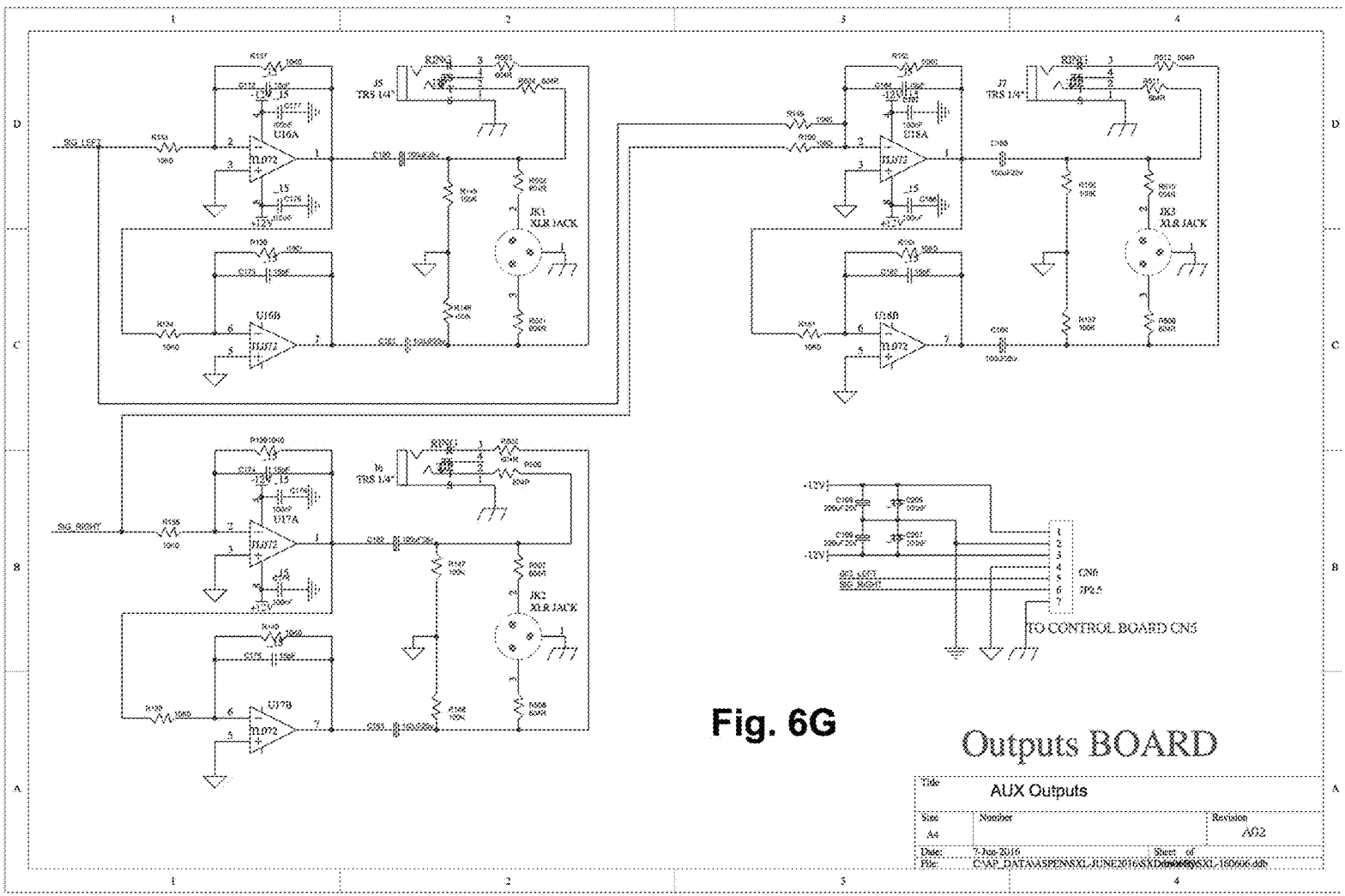
FIG. 6G is a detailed circuit diagram of the digital transducer alignment sound processor used in our improved center point stereo system depicted in FIG. 4.
Figure 6H:
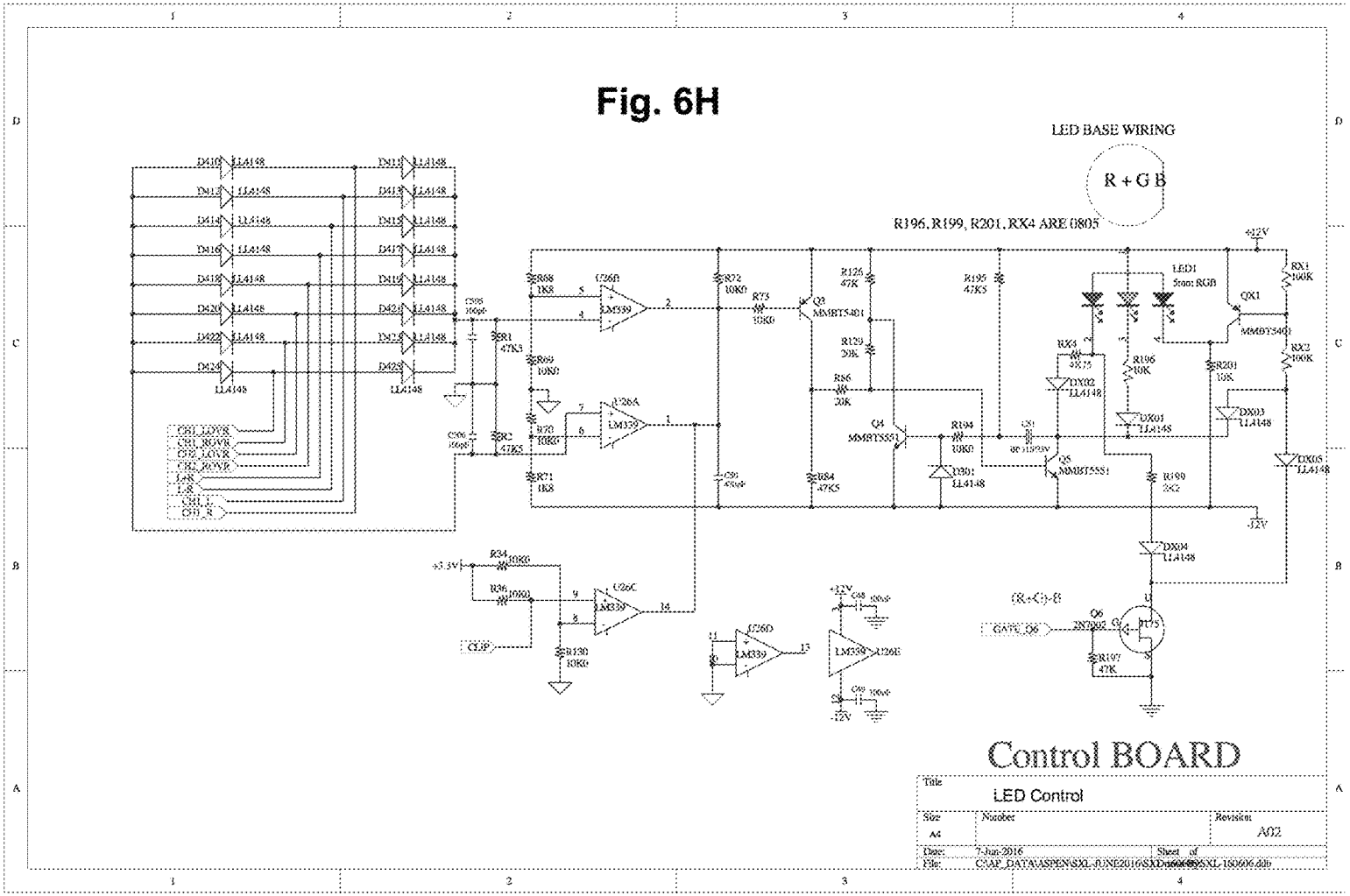
FIG. 6H is a detailed circuit diagram of the digital transducer alignment sound processor used in our improved center point stereo system depicted in FIG. 4.

FIGS. 6A-H are detailed circuit diagrams of the digital transducer alignment sound processor 130 used in our improved center point stereo system 2. As illustrated in FIG. 6C, the digital transducer alignment sound processor 130 utilizes the ADAU1701 SigmaDSP® and is derived from the mini evaluation board manufactured by Analog Devices, Inc. (Appendix B). The ADAU1701 provides stereo line-level analog audio input as well as a digital audio interface. The digital transducer alignment sound processor 130 contains an audio time delay circuit that can generate a time delay ranging from 0.1 to 100 milliseconds. The digital transducer alignment sound processor 130 records the difference, (L−R) signal D to an internal audio storage medium, and then plays the difference signal D back after a time period equal to or greater than the time the audio signal source 100 is acoustically transmitted from the center point CP1 to the faces, F1 and F2, of the respective pair of loudspeakers 180*a* and 180*b*. in the embodiment shown in FIG. 4, the most pronounced stereo effect is obtained when the time delay is 3 milliseconds in reference to the sum (L+R) signal S delivered to the forward-directed loudspeaker unit 160. The effect of the digital transducer alignment sound processor 130 on the difference (L−R) signal D is to time align and acoustically reposition the loudspeakers 180*a* and 180*b* so they radiate in the time domain in reference to the center point CP1 of the forward-directed loudspeaker 160*a*.

SCOPE OF THE INVENTION

The above presents a description of the best mode we contemplate for carrying out our center point stereo system, and of the manner and process of making and using it, in such full, clear, concise, and exact terms as to enable a person skilled in the art to make and use. Our center point stereo system is, however, susceptible to modifications and alternate constructions from the illustrative embodiments discussed above which are fully equivalent. Consequently, it is not the intention to limit our center point stereo system to the particular embodiments disclosed. On the contrary, our intention is to cover all modifications and alternate constructions coming within the spirit and scope of our improved center point stereo system as generally expressed by the following claims, which particularly point out and distinctly claim the subject matter of our invention:

The invention claimed is:

1. A center point stereo music performance system for providing a real time, stereo musical source signal generated by a musical instrument comprising a cabinet containing a center point stereo sound processor, a digital transducer alignment sound processor, first and second dissimilar loudspeaker units spatially separated, dedicated amplifiers to drive separately the loudspeaker units, said center point stereo sound processor and digital transducer alignment sound processor electrically connected together to process said stereo musical source signal, said first and second dissimilar loudspeaker units being co-located at a common center point and said cabinet having a front panel and opposed side panels, said cabinet panels are vertically oriented and the side panels at a right angle to the front panel, and said opposed side panels separated by a distance from 1 to 120 inches, said first loudspeaker unit comprising a full frequency forward-directed loudspeaker unit arranged to emanate a sum signal sound field in a unidirectional pattern and having a speaker cone with an open mouth centrally positioned at the front panel of the cabinet and an apex end at the common center point within an enclosure positioned along a longitudinal reference line, and in a separate enclosure within the cabinet, the second loudspeaker unit comprising a full frequency sideways-directed dipole loudspeaker unit having a pair of individual speaker cones below and to a side of the forward-directed loudspeaker unit, with one speaker cone having an open mouth in one side panel of the cabinet and the other speaker cone having an open mouth in another side panel of the cabinet, said individual speaker cones having an apex end lying along a common lateral reference line, said sideways-directed dipole loudspeaker unit arranged to emanate difference signal sound fields in a dipole pattern of opposite phase polarity and in opposite sideways directions generally perpendicular to the forward-directed loudspeaker, the sideways-directed dipole loudspeaker unit being spatially separated and separately driven by its dedicated amplifier to acoustically transduce the sum and difference signals of said stereo musical source signal into left and right stereophonic sound images emanating from said spatially separated loudspeaker units, said images being out of time alignment due to said distance separating the speaker cones in the sideways-directed dipole loudspeaker unit from the longitudinal reference line, said longitudinal reference line and common lateral reference line intersecting at a point midway between the open mouths of the pair of individual speaker cones, and the individual speaker cones of the pair being equally spaced from the longitudinal reference line a distance of at least 0.05 to 1 inch, said dedicated amplifiers including a first audio power amplifier receiving as input a line level sum signal from the center point stereo sound processor and providing as output a power amplified sum signal, and a second audio power amplifier receiving as input a line level difference signal from the digital transducer alignment sound processor and providing as output a power amplified difference signal, said digital transducer alignment sound processor including an audio time delay circuit to delay the difference sound fields reaching a listener via a predominantly reflected path to combine aurally with the sum sound field such that a listener is caused to perceive enhanced stereophonic images representing a performed music spread panoramically left and right of a common central loudspeaker location, said audio time delay circuit providing a time delay from 0.1 to 100 milliseconds.

* * * * *